US007427100B2

(12) United States Patent
Joseph

(10) Patent No.: US 7,427,100 B2
(45) Date of Patent: Sep. 23, 2008

(54) CONVERTIBLE ARTICLE AND METHOD

(76) Inventor: John G Joseph, c/o Shoot -A-Way, Inc. 3305 County Rd., Upper Sandusky, OH (US) 43351

( * ) Notice: Subject to any disclaimer, the term of this patent is extended or adjusted under 35 U.S.C. 154(b) by 451 days.

(21) Appl. No.: 11/003,893

(22) Filed: Dec. 3, 2004

(65) Prior Publication Data

US 2006/0138809 A1 Jun. 29, 2006

(51) Int. Cl.
*A47C 13/00* (2006.01)
*A63B 63/08* (2006.01)

(52) U.S. Cl. ..... 297/118; 297/181; 473/472; 473/481

(58) Field of Classification Search ..... 297/118, 297/181, 16.1; 473/472, 481
See application file for complete search history.

(56) References Cited

U.S. PATENT DOCUMENTS 4,006,910 A * 2/1977 Beckley ..... 297/16.1 X
4,697,810 A 10/1987 Mathison
4,869,502 A 9/1989 Wares
4,913,431 A 4/1990 Jakobs
4,936,577 A 6/1990 Kington et al.
4,955,605 A 9/1990 Goldfarb
5,016,875 A 5/1991 Joseph
5,080,430 A 1/1992 Castro
5,090,694 A 2/1992 Pauls et al.
5,273,275 A 12/1993 Wilkerson
5,310,176 A 5/1994 Berg
5,333,853 A 8/1994 Hektor
5,368,292 A 11/1994 Metz
5,423,592 A 6/1995 Spurrier et al.
5,690,379 A * 11/1997 Cayssials ..... 297/118
5,720,485 A 2/1998 Oswald
5,830,088 A 11/1998 Franklin de Abreu
5,910,058 A 6/1999 Zheng
5,947,847 A 9/1999 van Nimwegen et al.
6,056,652 A 5/2000 Lees et al.
6,116,682 A * 9/2000 Baur ..... 297/181
6,357,824 B1 3/2002 Whitacre
6,688,627 B1 2/2004 Strange
6,761,649 B1 7/2004 Medley, Jr.

* cited by examiner

*Primary Examiner*—Anthony D. Barfield
(74) *Attorney, Agent, or Firm*—Jacox, Meckstroth & Jenkins

(57) ABSTRACT

A method and apparatus reversibly converting a chair into a basketball goal. Four operating modes are disclosed. A first mode in which the article is configured as a basketball goal, a second mode in which the article is configured as a chair within an upwardly extended backboard, a third mode in which a net is deployed for returning basketballs to a shooter and a fourth mode wherein the article is configured as a chair with the backboard collapsed therebehind.

20 Claims, 10 Drawing Sheets

MODE I

MODE II

MODE I

MODE II

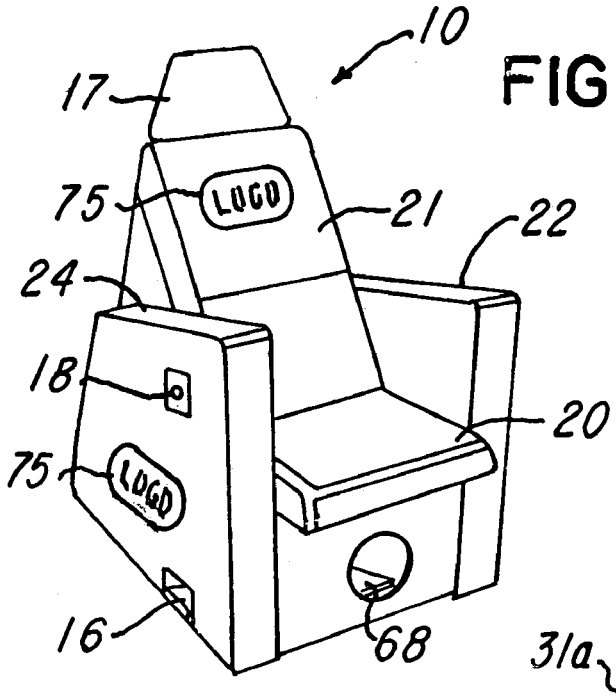
FIG-1A
MODE IV
FIG-3
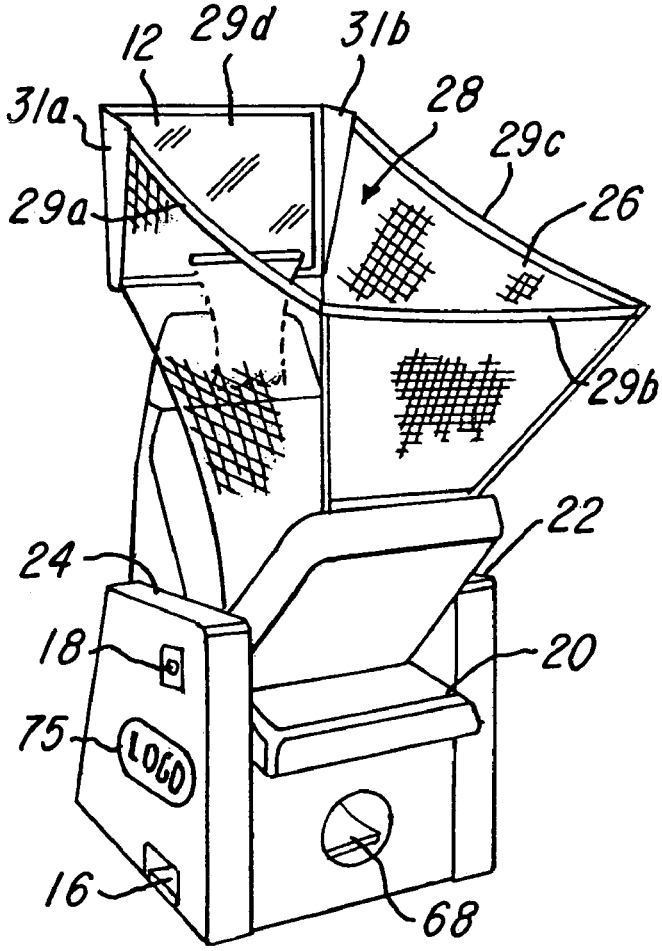
MODE III

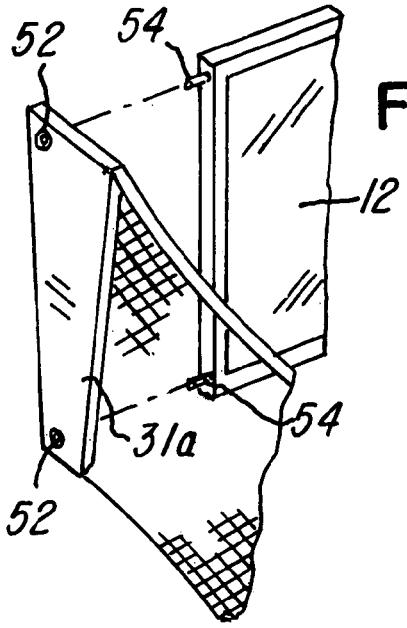
FIG-4
FIG-5
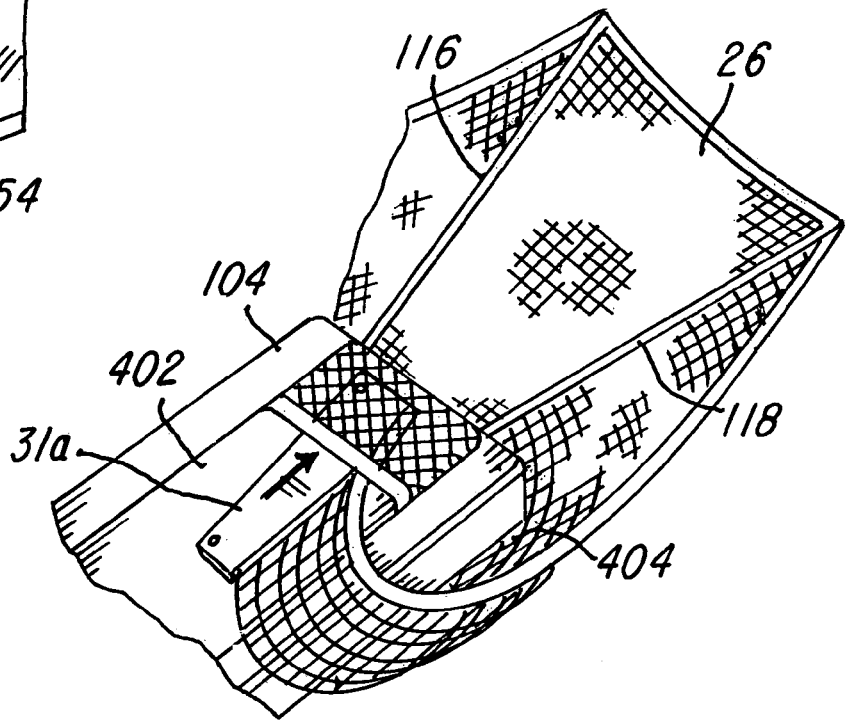
FIG-6
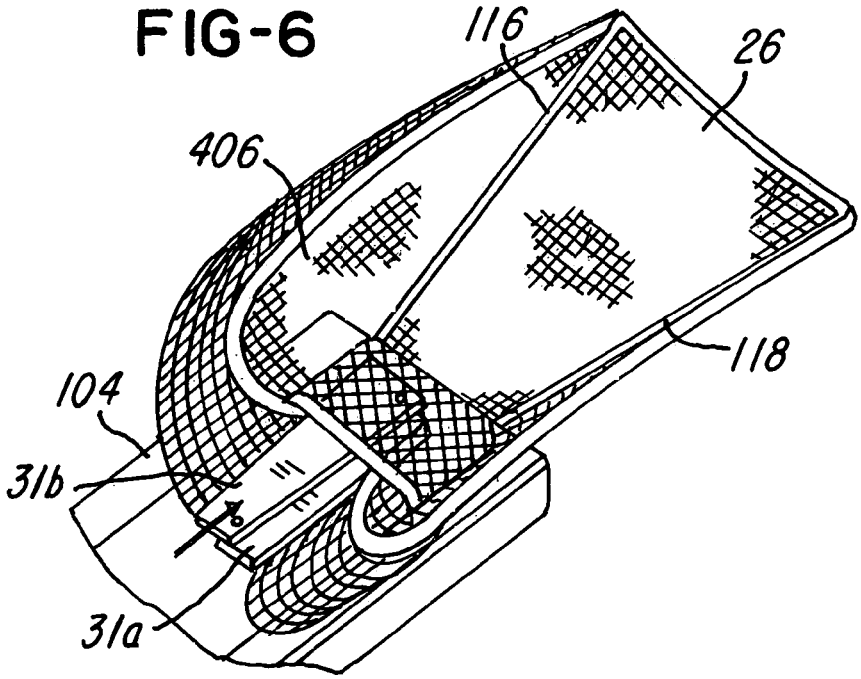

12
66
28
26
10
14
15
230
72a
66a
104
72b
147
106d
40b
206b
208
70
66a
44b
66a
150
42b
72c
66a
72
68
105

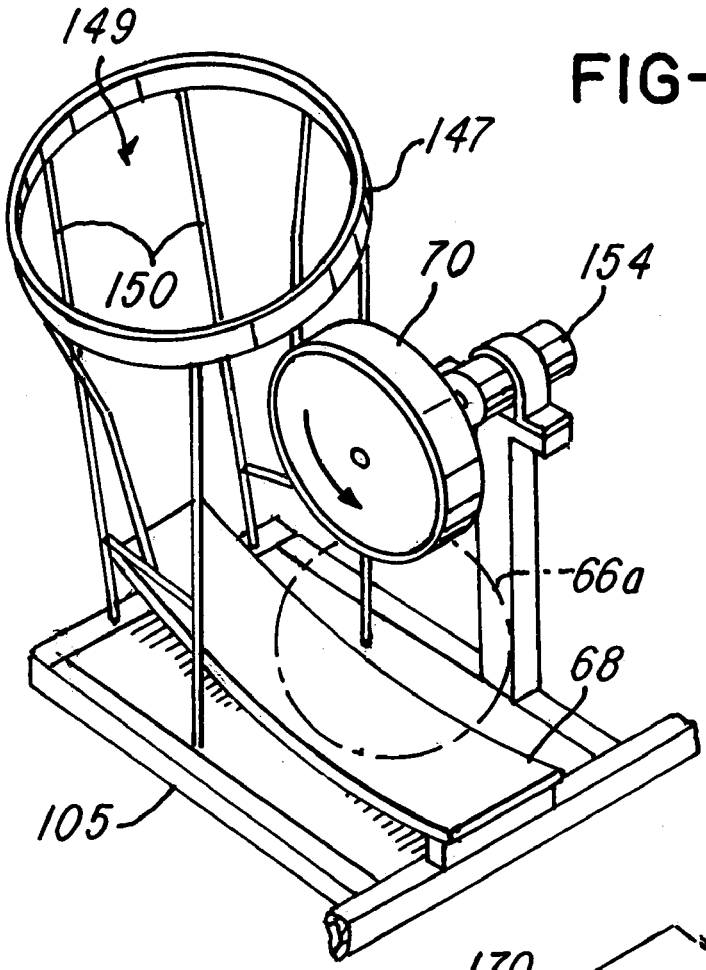
FIG-11
FIG-12
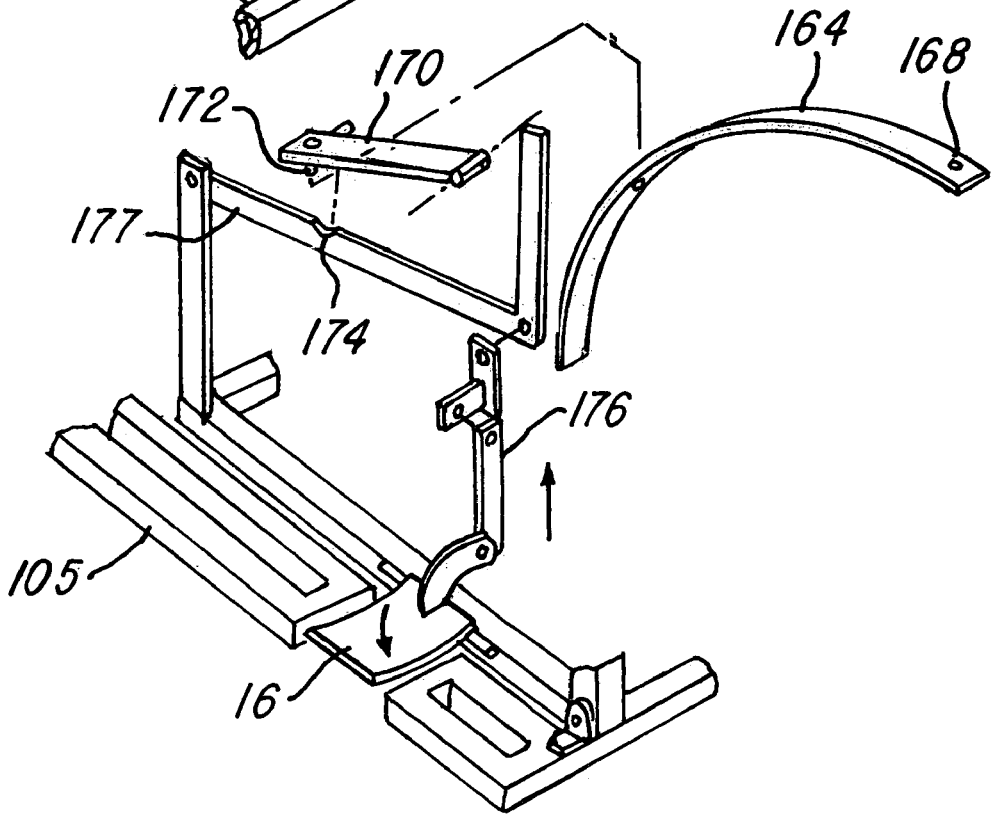

CONVERTIBLE ARTICLE AND METHOD

BACKGROUND OF THE INVENTION

This invention relates to articles which are adapted for a plurality of different uses, and more particularly, to an article which is reversibly convertible between a basketball goal and a chair. Given such adaptability, the article is useful in a wide variety of different environments, such as gymnasiums, offices having high ceilings and back yards or patios having hard, level, surfaces. Moreover, the article is easily moveable between locations having a need only for one or the other of the plurality of article capabilities.

While the prior art contains numerous teachings relating to devices for retrieving basketballs launched at a basketball hoop, there appears no prior art suggestion to incorporate a chair into a combination with a basketball retriever. See for instance:

| | | |
|---|---|---|
| Mathison | U.S. Pat. No. 4,697,810 | Oct. 6, 1987 |
| Wares | U.S. Pat. No. 4,869,502 | Sep. 26, 1989 |
| Jakobs | U.S. Pat. No. 4,913,431 | Apr. 3, 1990 |
| Kington, et al | U.S. Pat. No. 4,936,577 | Jun. 26, 1990 |
| Joseph | U.S. Pat. No. 5,016,875 | May 21, 1991 |
| Wilkerson | U.S. Pat. No. 5,273,275 | Dec. 28, 1993 |
| Berg | U.S. Pat. No. 5,310,176 | May 10, 1994 |
| Hektor | U.S. Pat. No. 5,333,853 | Aug. 2, 1994 |
| Oswald | U.S. Pat. No. 5,720,485 | Feb. 24, 1998 |
| Franklin d e Abreu, Rua | U.S. Pat. No. 5,830,088 | Nov. 3, 1998 |
| Lees et al | U.S. Pat. No. 6,056,652 | May 2, 2000 |
| Medley, Jr. | U.S. Pat. No. 6,761,649 B1 | Jul. 13, 2004 |

SUMMARY OF THE INVENTION

This invention relates to articles adapted for a plurality of different uses and to a method for using such articles. More particularly, the invention relates to an article which can be reversibly morphed from a chair to a basketball goal and back again to a chair. A preferred embodiment of the invention may be configured reversibly into any of a plurality of different operating modes, such as illustrative Modes I through IV. In a first illustrative Mode I, the article is configured as a chair having an upwardly extended backboard assembly. In an illustrative Mode II configures the article as a stand-up basketball goal. In an illustrated Mode III is adapted for playing "toss-back" type games wherein a large ball return net captures basketballs projected into a region surrounding the backboard assembly and returns them to a predetermined location. In an illustrated Mode IV is a variation of Mode I wherein the backboard assembly is collapsed downwardly to a position generally not visible from the front of the morphed chair.

An article according to this invention may comprise a steel frame skeleton covered by plastic foam padding. This skeleton may comprise a mainframe which can be pivoted reversibly between a reclining position and a standing position. A latching arrangement is provided, so that the mainframe may be secured in either the reclining position or the standing position. A mechanical foot switch can be employed for setting and releasing the latches.

The skeleton also comprises a seat assembly and a backrest. The seat assembly is linked to the mainframe in such a way as to assume a horizontal position when the mainframe is reclining and a vertical position when the mainframe is standing.

It is therefore an object of the invention to provide an apparatus and method for converting an article between disparate operating modes.

It is another object of the invention to convert a chair to a basketball goal and a basketball goal into a chair, A further object of the invention is to promote healthy leisure time activity.

Yet another object of the invention is to provide a convertible object comprising: a seat, a seat back pivotally joined to the seat, means for defining a basketball goal by concomitantly placing the seat back and the seat in standing positions and means for defining a chair by concomitantly placing the seat back in a reclining position and the seat in a horizontal position.

Other and further objects and advantages of the invention become apparent from the following description, the accompanying drawings and the appended claims.

BRIEF DESCRIPTION OF THE DRAWING

FIG. 1A illustrates a convertible article arranged in a fourth mode as a chair with the basketball assembly collapsed.

FIG. 3 illustrates the convertible article arranged in a third mode wherein a ball return net is deployed for collecting and returning basketballs projected toward a basketball hoop;

FIG. 4 illustrates a joint between a basketball backboard and a basketball return net;

FIG. 5 illustrates a pocket having approximately one-half of a basketball return net stuffed therein;

FIG. 6 illustrates the pocket of FIG. 5 with an entire basketball return net stuffed therein;

FIG. 11 illustrates apparatus for discharging a basketball for return to a shooter;

FIG. 12 illustrates the operation of a foot switch in initiating a mode change for the convertible article;

DESCRIPTION OF THE PREFERRED EMBODIMENT

The preferred embodiment of the invention may take the shape of a convertible article 10, able to appear from time-to-time in any one or a plurality of distinctly different configurations. For ease of illustration, configurations operate in four different illustrative modes, hereinafter referred to as Modes I-IV, Explanations of Modes I-IV follow.

Figure 1:
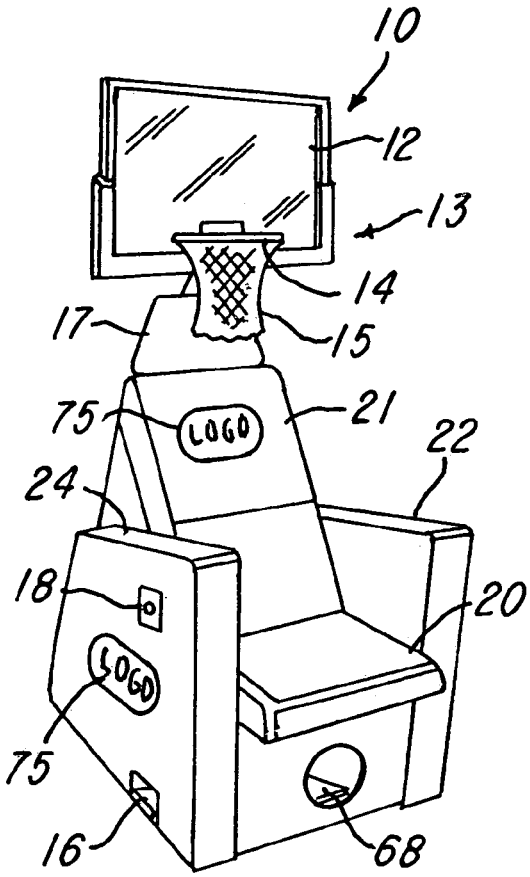
FIG. 1 illustrates a convertible article arranged in a first mode as a chair.

Mode I configures article 10 as a chair (FIG. 1). During continuance of Mode I the convertible article 10 has a seat assembly 20, a backrest 21 and a backboard assembly 13. Seat assembly 20 comprises right and left risers 206*a*, 206*b*, crossbar 208, legs 42*a*, 42*b* and wheels 44*a*, 44*b*. Backboard assembly 13 comprises a backboard 12, a hoop 14 and a net 15. As shown in FIG. 1, backboard assembly 13 may be positioned upright in a visible location atop article or chair 10. Alternate positioning of backboard assembly 13 is available under Mode IV, as discussed below.

Seat assembly 20 extends laterally between a left arm 22 and a right arm 24. A headrest 17 may be positioned atop backrest 21. Backrest 21, right arm 24, and left arm 22 are all visible to an observer. Also visible to an ordinary observer are optional logos 75, which may be decals promoting a charitable organization, a university, a professional sports team or the like.

Figure 15:
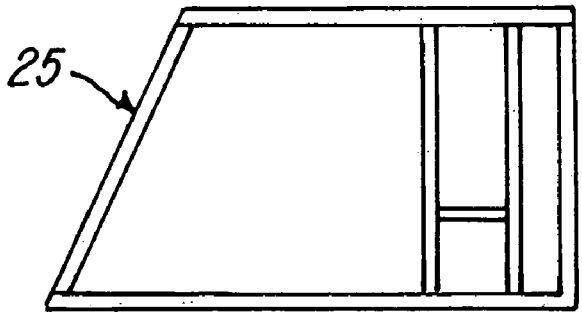
FIG. 15 illustrates a frame for an arm rest.

A non-visible skeleton 50 (FIG. 7) provides internal support for convertible article 10 in all of its modes. Skeleton 50 preferably is fashioned from welded steel bar or tubular members. Preferably arms 22, 24 are defined by wood frames 25, 25 (FIG. 15) secured to base frame 105 (FIG. 7) of skeleton 50. Padding, preferably foam plastic, is positioned on or molded against wood frames 25, 25 and all exposed surfaces of skeleton 50, as illustrated in FIG. 15. Wood frames 25, 25 are identical in construction. Therefore, only one wood frame 25 is shown in FIG. 15.

Figure 2:
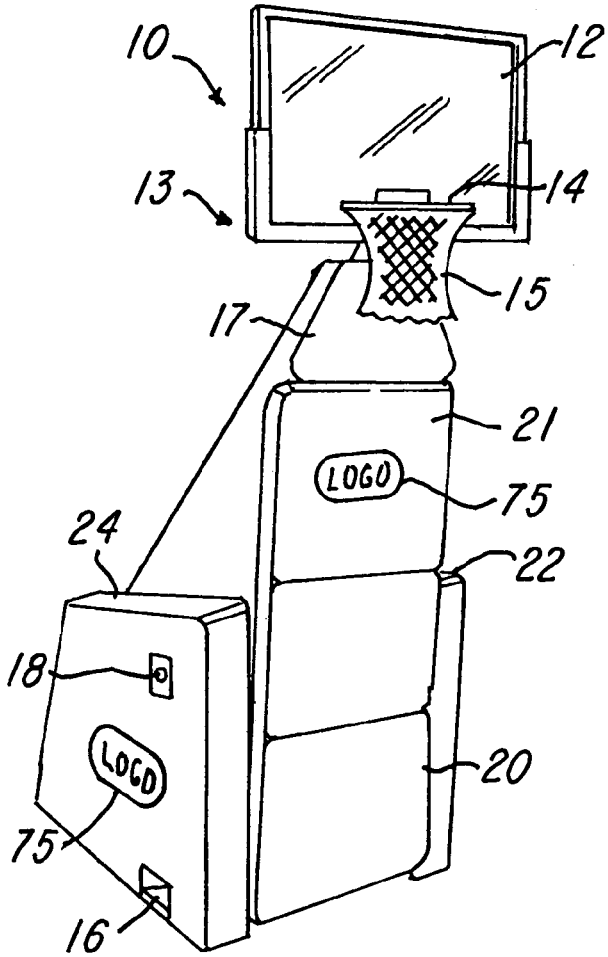
FIG. 2 illustrates the convertible article arranged in a second mode as a basketball goal.
Figure 13:
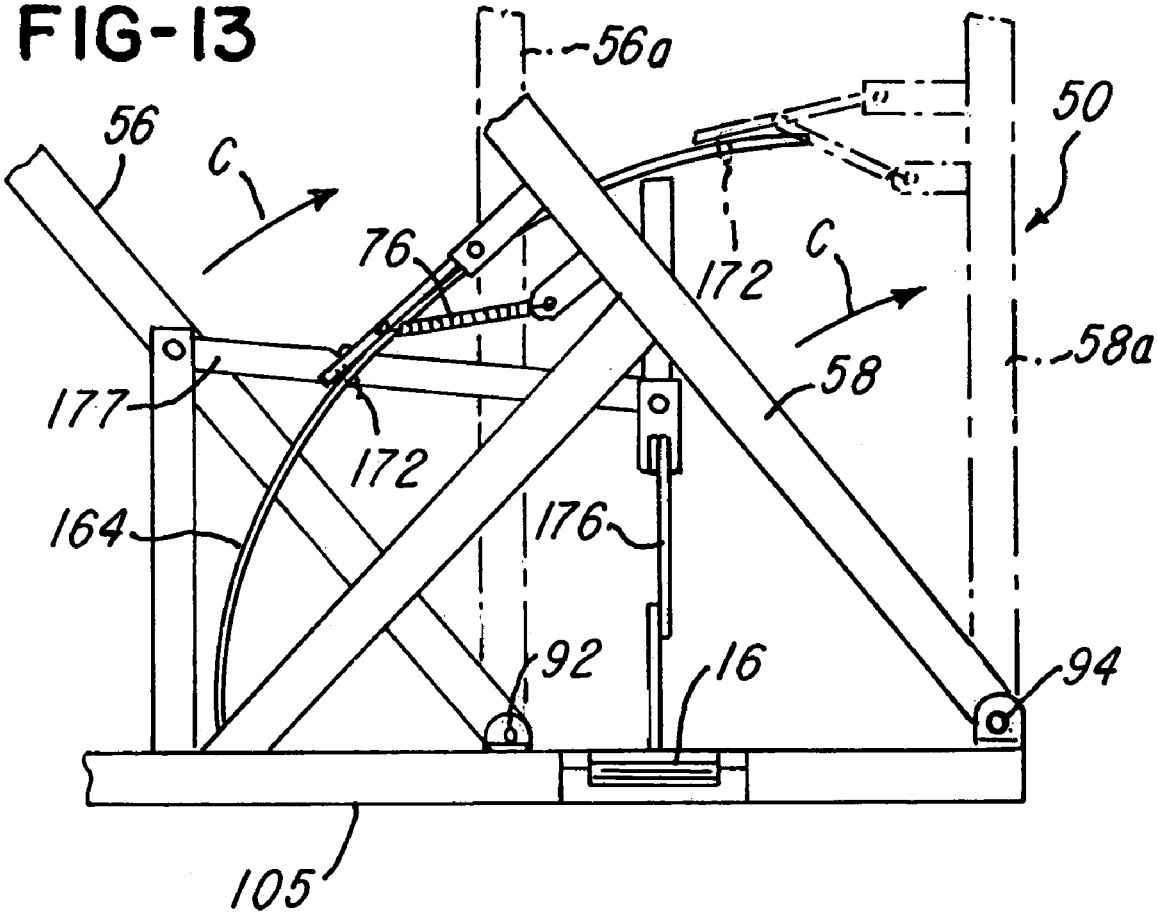
FIG. 13 illustrates the motion of primary support rods during deployment of a ball return net.

FIGS. 2, 12 and 13 illustrate convertible article 10 as it operates in Mode II. Here, convertible article 10 is being used as a standup basketball goal. It is able to maintain a stance in this position by reason of a cam surface 164 and a cam follower 170. Cam surface 164 has a pair of index apertures 166, 168 which may be engaged by a projection 172 on cam follower 170. Cam follower 170 is spring biased against a notch 174 of an arm 177. When an operator depresses foot switch 16 (FIG. 13) it produces vertical movement of linkage generally designated by reference numeral 176. Vertical movement of linkage 176 causes cam follower 170 to be pushed out of engagement with notch 174 and to slide along the outside surface of cam 164. The operator swings support rods 56, 56 and 58, 58 in the direction of arrow B until cam follower 170 is pulled into engagement with one or the other of index apertures 166, 168.

FIG. 13 illustrates the lower portion of skeleton 50. Shown therein is the rotational movement of two pairs of support rods 56, 56*a* and 58, 58*a* when convertible article 10 is morphed from Mode I (solid lines) to Mode II (phantom lines). Support rods 56*a*, 58*a* do not appear in FIG. 13, because they are hidden behind support rods 56, 58 respectively. A mode change from Mode I to Mode II may be initiated by stepping on foot switch 16. Additional details of a morph from Mode I to Mode II are shown in FIG. 12. Illustrated therein is a linkage between foot switch 16 and a cam 164. The aforementioned cam follower 170 rides along the surface of cam 164 between a pair of apertures, 166, 168. Cam 164 has the projection 172 which releasably engages the notch 174 in arm 177. When foot switch 16 is depressed, a linkage 176 moves upward, lifting projection 172 from engagement with notch 174. It will be seen that cam 164 has the general shape of a circular arc.

Mode III is used for playing shooting games of a type wherein a basketball is automatically returned to a shooter. An illustration of convertible article 10, operating in Mode III, appears in FIG. 3. Mode III is entered from Mode I by pulling out seat assembly 20 to a position extending forward of left and right arms, 22 and 24 respectively. That deploys a ball return net 26, which is illustrated in FIG. 3. As shown in FIG. 3, ball return net 26 has three enclosed sides 29*a*, 29*b*, 29*c*, an open side 29*d* and an open top 28. The ball return net is stiffened by triangular fabric panels, 31*a*, 31*b* (FIG. 3). Fabric panels 31*a*, 31*b* are secured to backboard 12 by means of eye bolts 52 (FIG. 4) and quarter inch rods 54 in the manner shown in FIG. 4. A net deployment assembly 104, described later herein, may also be provided.

Figure 7:
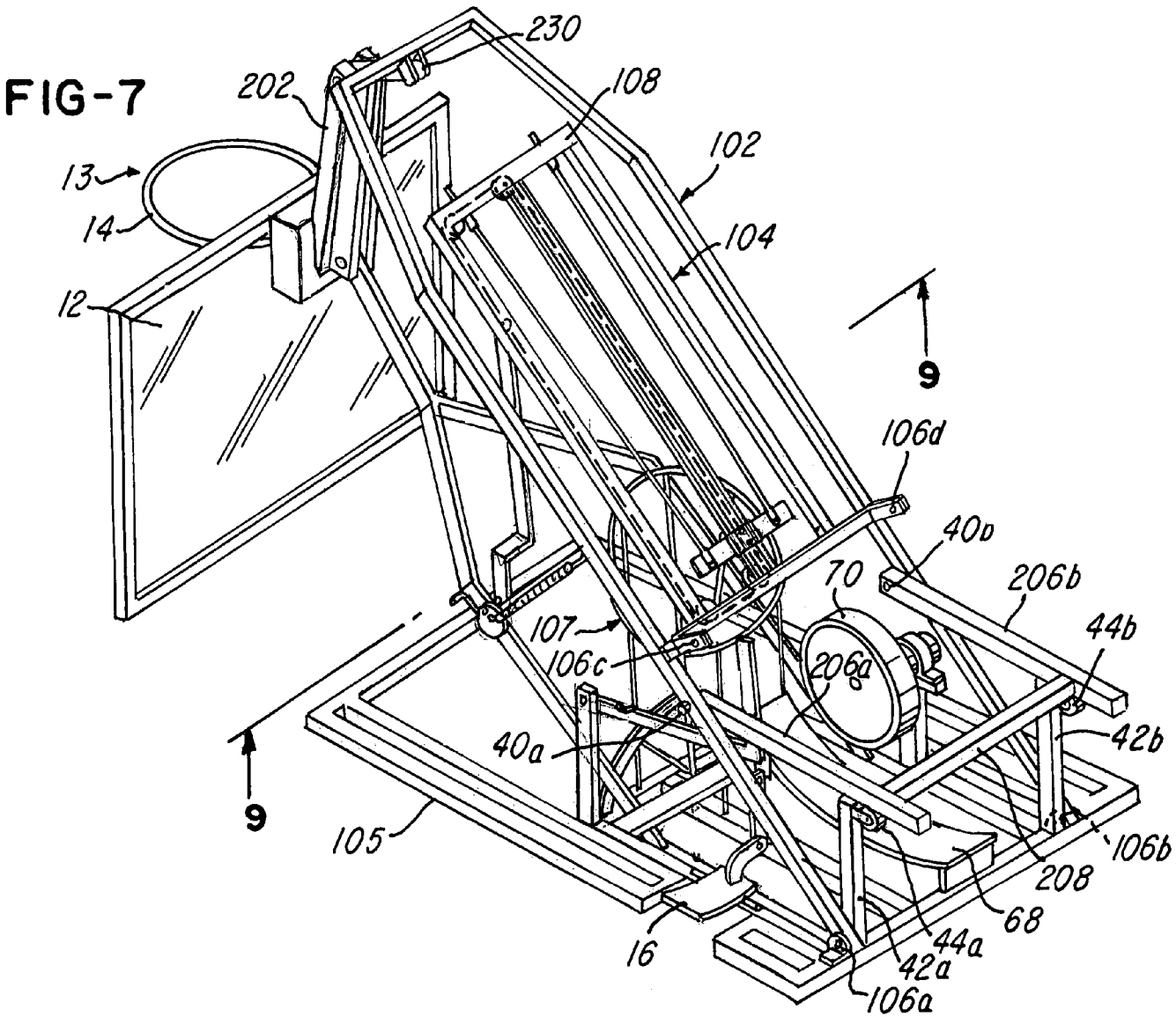
FIG. 7 illustrates a skeleton of a convertible article having a collapsed backboard assembly.

As mentioned above, the Mode I configuration places backboard assembly 13 in a position elevated above headrest 17. In some cases it may not be desirable to have a backboard assembly perched in such a location. Mode IV addresses that situation by collapsing backboard assembly 13 downwardly to the rear of convertible article 10, thereby hiding backboard 12, hoop 14 and net 15. FIG. 7 illustrates the configuration of skeleton 50 when convertible article 10 functions in Mode IV as a chair.

Figure 10:
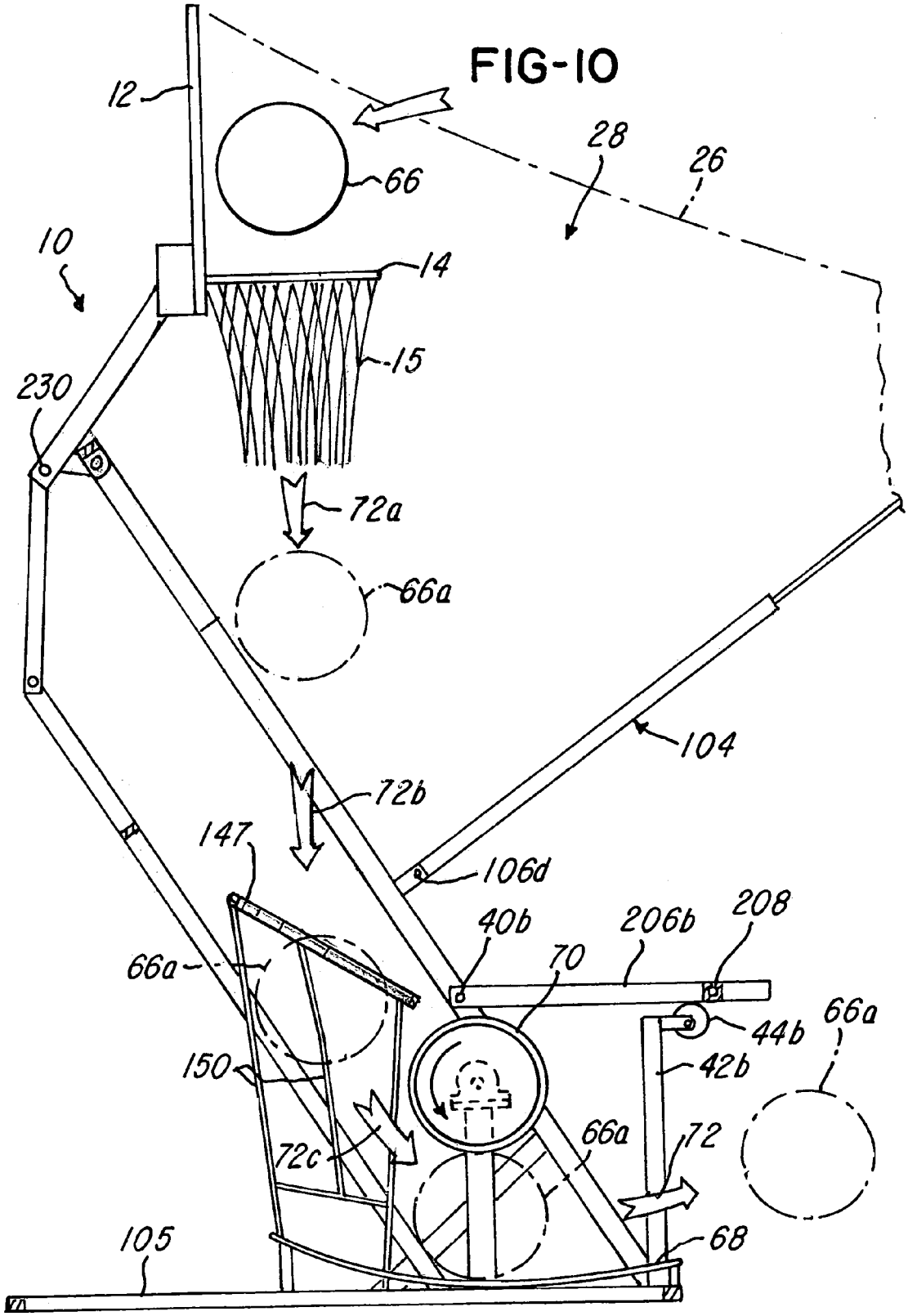
FIG. 10 illustrates the operation of skeletal elements of the convertible article when functioning in its third mode.

FIG. 10 illustrates the operation of convertible article 10 while in Mode III with ball return net 26 deployed. For ease of illustration, the article 10 is shown without padding or covering. In that condition a shooter may launch a basketball 66 on an arc intended to pass first through opening 28 and thereafter through hoop 14. A successful attempt to do so is credited to the shooter as a "basket" and scored in accordance with the rules in effect for the game.

An arrow 72 in FIG. 10 illustrates the termination of a successful shot wherein basketball 66 is corralled by hoop 14 and net 15 and is directed downwardly along a path illustrated by arrows 72*a*, 72*b*, and 72*c*. FIG. 10 also illustrates a series of basketball phantom line positions 66*a* as basketball 66 passes through convertible article 10. As the basketball 66 reaches the bottom of convertible article 10 it is engaged by a pulley 70, as illustrated in FIG. 11. Following engagement by pulley 70, basketball 66 exits convertible article 10 and returns to the shooter at a speed dependent upon the angular rotation rate of motor-driven pulley or wheel 70. There is a speed control 18 (FIGS. 1A and 3) on right arm 24 of convertible article 10 which can be used for adjusting the rotation rate of pulley 70 and thereby regulate the return speed of basketball 66. Exit guidance is provided by a curved discharge track 68 (FIG. 11).

Referring now to FIGS. 10 and 11, a returning basketball falls downwardly through a waistband 147 and into a chute 149 defined by stringers 150. As the basketball leaves chute 149, it is squeezed between pulley 70 and curved discharge track 68. Pulley 70 is driven by an electric motor 154 at a rotational speed governed by the setting of speed control 18.

FIG. 1 illustrates convertible article 10 in Mode I, whereas the configuration of FIG. 7 corresponds to a skeleton 50 operating in Mode IV. Principal parts of skeleton 50, as illustrated in FIG. 7, are a backboard assembly 13, a mainframe 102, a base frame 105, a chute assembly 107, a ball return assembly 111, and a net deployment assembly 104.

Figure 8:
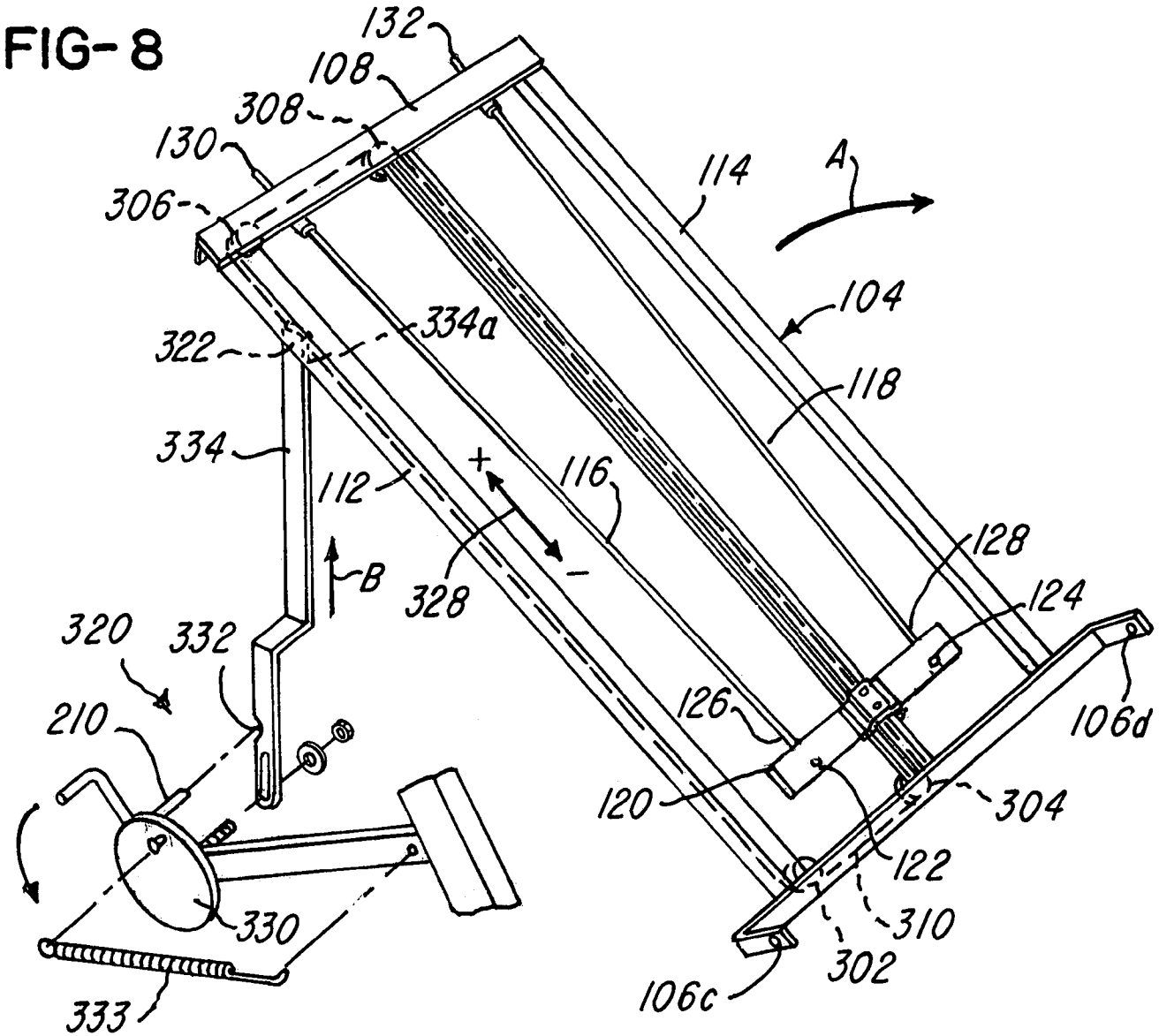
FIG. 8 illustrates a mechanism for deploying a ball return net.
Figure 9:
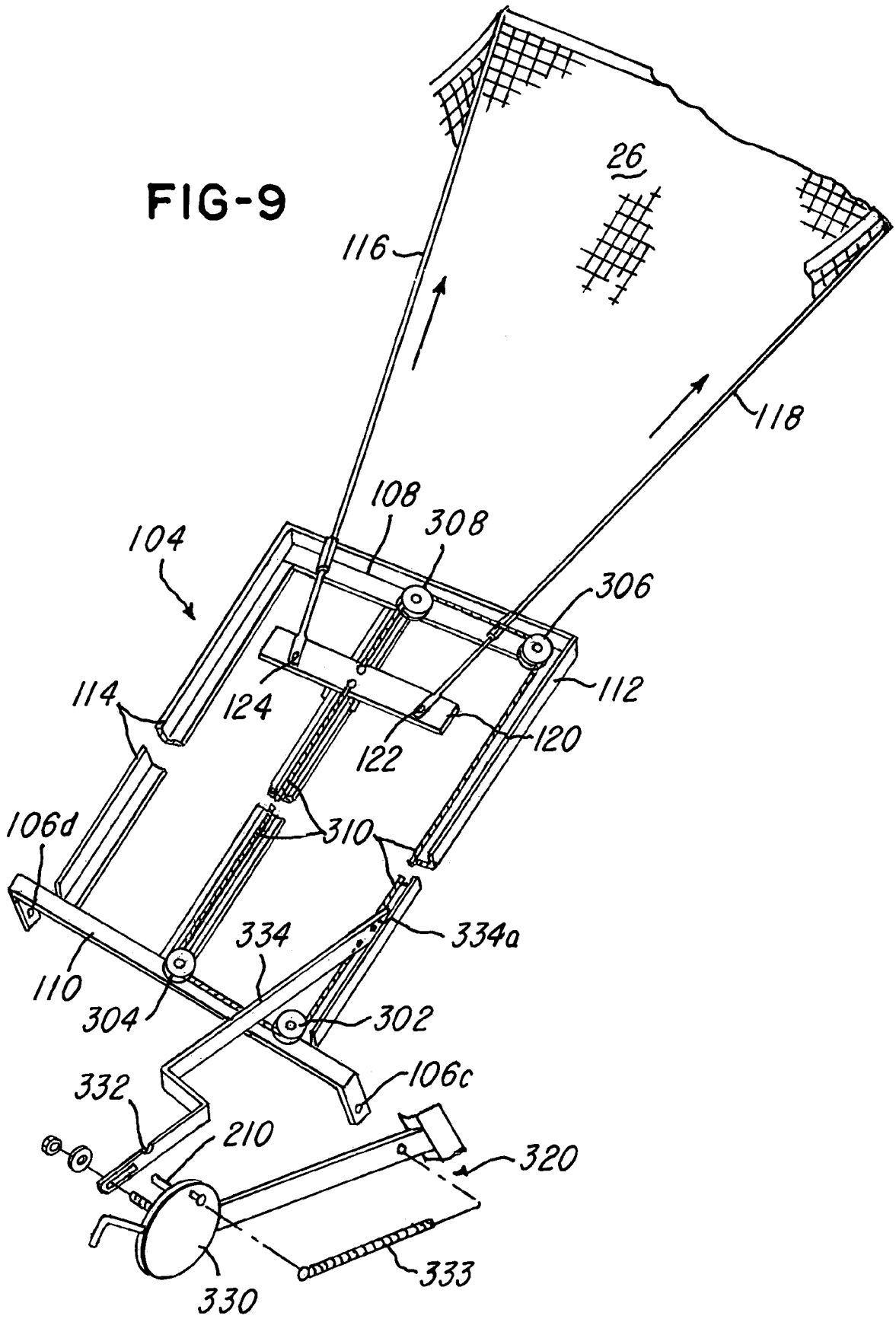
FIG. 9 illustrates the operation of the mechanism of FIG. 8.

Referring to FIGS. 8 and 9, net deployment assembly 104 has a generally rectangular configuration comprising a pair of spaced apart and parallel upper and lower frame members 108, 110, respectively, and a pair of parallel, spaced apart, first and second side frame members, 112, 114, generally normal to upper and lower frame members 108, 110 and secured endwise thereto. A guide rod 146 is secured to upper and lower frame members 108, 110 about midway between the first and second side frame members 112, 114, respectively. There is a slide bar 120 slidable along the length of guide rod 146 between upper frame member 108 and lower frame member 110. A pair of extension rods 116, 118 are secured to slide bar 120 at attachment points 122, 124 and extend from slide bar 120 to upper frame member 108.

Net deployment assembly 104 also has four pulleys 302, 304, 306, 308, a deployment rope 310 through guide rod 146, first side frame member 112 and portions of upper frame member 108 and lower frame member 110 extending there between. The viewing direction for FIG. 9 is from a back side of the net deployment assembly 104 and is generally indicated by lines 9-9 of FIG. 7. This is opposite the viewing direction for FIG. 8 of FIG. 7. Therefore, pulleys 302, 304, 306, 308 are visible in FIG. 9 and are hidden in FIG. 8. The same is true for deployment rope 310.

An actuator 320 has a finger 322 which is coupled to and able to move deployment rope 310 reversibly in + or – directions indicated by a double arrow 328 as an end 334*a* of a control rod moves towards and away respectively, from the upper frame member 108. Movement of deployment rope 310 in the + direction causes slide bar 120 to move in the direction toward upper frame member 108 while movement of deployment rope 310 in the minus direction moves slide bar 120 in the direction toward lower frame member 110. It should be understood that as the frame member 108 is pulled in upper direction of arrow X in FIGS. 8, 9 and 11, end 334*a* moves from the position shown in FIGS. 7 and 8 to the motion shown in FIGS. 9 and 11. The movement of end 334*a* pulls rope 310 in the minus (–) direction shown in FIG. 8. This movement of rope 310 pulls slide bar 120 toward upper frame member 108. This in turn causes extension rods 116 and 118 to move in the direction of arrow Y, thereby deploying the net which is coupled to the ends 130 and 132.

FIG. 9 illustrates the deployment sequence for net deployment assembly 104. The assembly 104 comprises a control plate 330 and a linear spring 333 connected in such a way as to create a spring bias forcing a locking pin 210 of control plate 330 to move into surface contact with the control rod 334. This causes locking pin 210 to fall into a notch 332 formed along an edge of control rod 334. Deployment of ball return net 26 commences by rotating control plate 330 into a position whereby locking pin 210 is clear of notch 332.

Once control rod 334 is disengaged from notch 332, net deployment assembly 104 is free to pivot about pivot points 106*a*, 106*b* in the direction indicated by arrow A. Net deployment assembly 104 is very light in weight even when carrying a net. Note that the assembly 104 lies in generally the same position or place as the backrest 21. Therefore, a human operator can easily swing net deployment assembly 104 from a reclining position to a vertical position by simply moving the backrest 21 from the position shown in FIG. 14 to the position shown in FIG. 3. As net deployment assembly 104 swings upwardly and outwardly, slide bar 120 moves in the positive direction +328. Extension rods 116, 118 are secured to ball return net 26 at their ends 130, 132 and deploy ball return net 26 as illustrated in FIG. 9. The process is easily reversed by reversely rotating control plate 330 and swinging net deployment assembly 104 reversely about pivot points 106*a*, 106*b*. This causes slide bar 120 to move toward upper frame member 108, reeling in ball return net 26, as it goes. The operator stores the net by stuffing the incoming net in a pocket in the manner illustrated in FIGS. 5 and 6.

There is a cavity 402 in the rear side of the plastic foam covering net deployment assembly 104. A pocket 404 is defined by netting secured to cavity 402. When ball return net 26 is retracted half of the netting is gathered around fabric panel 31*a* and stuffed into pocket 404. The remaining netting is gathered about fabric triangle 31*b* and also stuffed into pocket 404. Thereafter, backrest 21 is closed, trapping ball return net 26 out of sight in cavity 402.

During deployment of ball return net 26 extension rods 116, 118 engage ball return net 26 and push it outwardly away from lower frame member 110. It is a manual operation and proceeds simply by releasing a latch (not illustrated) and pulling upper frame member 108 to an upright position. Backboard assembly 13 is supported by a support rod 202 (FIG. 7) attached to mainframe 102 at a swivel 230. It may be noted that skeleton 50 appears in FIG. 7 with backboard assembly 13 collapsed. The collapsing of backboard assembly 13 morphs convertible article 10 into the Mode IV configuration.

The pulley arrangement illustrated in FIG. 9 is but one of many assemblies which are well known for obtaining the mechanical motion required for this task.

Figure 14:
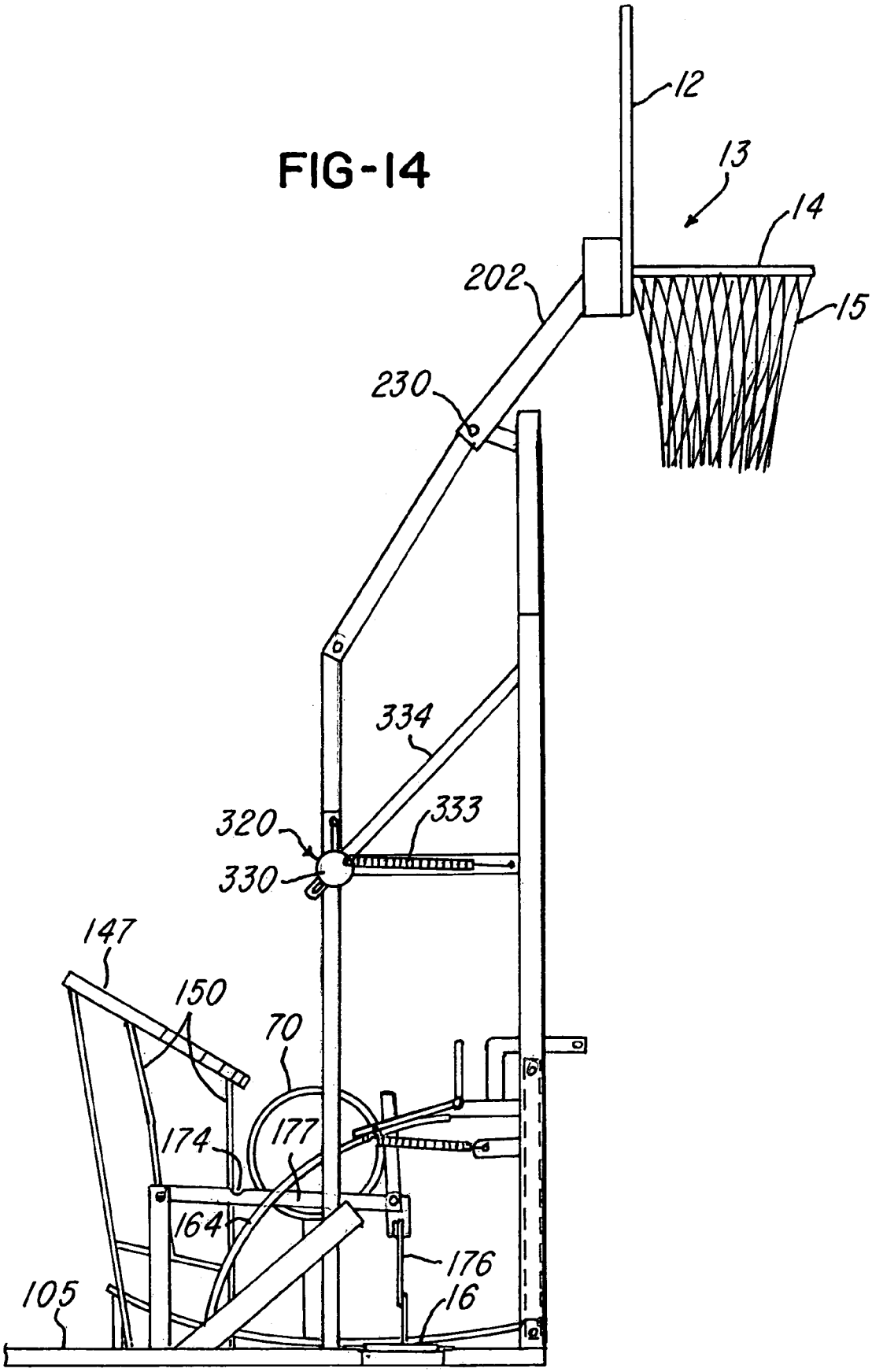
FIG. 14 is a side elevation view of skeletal elements of the convertible article as configured in its first mode.

Support rods 56, 58 (FIG. 13) are pivotally joined to base 90 at pivot points 92, 94. Support rods 56, 58 may be tilted from a reclining orientation shown in FIG. 13 to an upright position as shown in FIG. 14. Cam 164 locks support rods 56, 58 selectively into either the reclining position or the upright position. It should be observed that support rods 56, 58 remain parallel throughout the morphing process. After foot switch 16 has been depressed the operator completes the morph from Modes I or IV to Mode II by simply moving backrest 21 (FIG. 8), which in one turn moves support rods 56 or 58, and swinging it angularly upward in the direction shown by arrows C of FIG. 13.

As support rods 56, 58 are elevated from a reclining position to an upright position shown in upright in FIG. 13 and in FIGS. 2 and 14, seat assembly 20 collapses. Collapsing of seat assembly 20 proceeds automatically with the elevation of support rods 56, 58. The collapse of seat assembly 20 is characterized by downward rotation of right and left risers, 206*a*, 206*b* (FIG. 7) on which the seat is mounted about pivot points 40*a*, 40*b*, coupled with generally downward rolling motion of risers 206*a*, 206*b* and cross bar 208 across wheels 44*a*, 44*b*.

While the method herein described, and the forms of apparatus for carrying this method into effect, constitute preferred embodiments of this invention, it is to be understood that the invention is not limited to this precise method or forms of apparatus, and that changes may be made in either without departing from the scope of the invention, which is defined in the appended claims.

What is claimed is:

1. A process comprising the steps of:

(1) sitting in a chair comprising a plurality of elements, (2) reorganizing said plurality of elements to define a basketball goal, including an elevated hoop, (3) projecting a basketball along an arc which rises and falls while traveling in a direction generally toward said elevated hoop, (4) reorganizing said plurality of elements to redefine said chair; and said basketball goal being permanently secured to said chair so that after said step (4) said basketball goal is in a stored position.

2. A process according to claim 1 wherein said reorganization of said reorganizing step includes the sub-step of deploying a ball return net for trapping basketballs which fail to pass through said elevated hoop.

3. A process according to claim 1 wherein said plurality of elements comprises a second net, substantially smaller than said ball return net, said second net being secured to said elevator hoop for providing a visual indication of shots successfully passing through said elevated hoop.

4. A process according to claim 3 wherein said plurality of elements comprises a speed control and means responsive to said speed control for adjusting the return speed of basketballs trapped within said ball return net, said process including the sub-step of manipulating said speed control to adjust said return speed.

5. A convertible article comprising:

(a) a seat, (b) a seat back extending upwardly from said seat, (c) a basketball backboard secured to said seat back, (d) a hoop secured to said basketball backboard, and (e) mode changing means for defining a basketball goal by raising said seat back from a reclining position to a standing position and alternatively defining a chair by lowering said seat back from a standing position to a reclining position, said basketball backboard being permanently affixed to said chair and becoming stored when said convertible article defines said chair.

6. Apparatus according to claim 5 wherein said left arm rest and said right arm rest are covered by padding.

7. Apparatus according to claim 6 wherein said left arm rest and said right arm rest are covered by padding.

8. Apparatus according to claim 6 wherein said left arm rest and said right arm each comprise a wood frame covered by foam padding.

9. Apparatus according to claim 8 further comprising a headrest available while said apparatus is in a chair-defining mode.

10. A convertible article comprising:

(a) a seat, (b) a seat back extending upwardly from said seat and having a basketball backboard secured thereto, (c) a hoop secured to said basketball backboard, (d) first orienting means for rotating said seat back between a reclining orientation and a substantially vertical orientation, and (e) second orienting means for rotating said seat to a substantially vertical orientation when said seat back rotates from a reclining orientation to a vertical orientation and rotating said seat to a substantially horizontal orientation when said seat back rotates from a vertical orientation to a reclining orientation, so that said article morphs between a chair mode and a basketball goal mode when said seat back rotates between a reclining orientation and a substantially vertical orientation, said basketball backboard being permanently secured or affixed to said seat back and becoming stored when said seat back is in said reclining orientation.

11. Apparatus according to claim 10 further comprising:

(f) a first net attached to said hoop for confirming a successful shot.

12. A convertible article comprising:

(a) a seat, (b) a seat back extending upwardly from said seat and having a basketball backboard secured thereto, (c) a hoop secured to said basketball backboard, (d) first orienting means for rotating said seat back reversibly between a reclining orientation and a substantially vertical orientation, (e) second orienting means for rotating said seat to a substantially vertical orientation when said seat back rotates from a reclining orientation to a vertical orientation and rotating said seat to a substantially horizontal orientation when said seat back rotates from a vertical orientation to a reclining orientation, so that said article morphs between a chair mode and a basketball goal mode when said seat back rotates between a reclining orientation and a substantially vertical orientation, said basketball backboard being permanently secured or affixed to said seat back, (f) a first net attached to said hoop for confirming a successful shot, and (g) a second net for trapping basketballs projected into a predetermined region including at least all of said first net.

13. Apparatus according to claim 12 further comprising:

(h) means for deploying said second net, and (i) means for retrieving said second net.

14. Apparatus according to claim 13 further comprising:

(j) an enclosed space behind said seat back for storing said second net.

15. A convertible article comprising:

(a) a seat, (b) a seat back pivotally joined to said seat, (c) a plurality of elements and a chair having a seat back and seat, said plurality of elements defining a basketball goal when said seat back and said seat are placed in standing positions, and (d) said plurality of elements defining said chair when said seat back is placed in a reclining position and said seat is placed in a horizontal position, said basketball goal being permanently affixed to said seat back and becoming stored when said chair is defined.

16. The convertible article according to claim 15 further comprising:

(e) a basketball backboard secured to said seat back, and (f) a hoop secured to said basketball backboard.

17. A convertible article comprising:

(a) a seat, (b) a seat back pivotally joined to said seat, (c) means for defining a plurality of elements and a chair having a seat back and seat, said plurality of elements defining a basketball goal by concomitantly placing when said seat back and said seat are placed in standing positions, (d) means for said plurality of elements defining a said chair by concomitantly placing when said seat back is placed in a reclining position and said seat is placed in a horizontal position, said basketball goal being permanently affixed to said when and becoming stored when said chair is defined, (e) a basketball backboard secured to said seat back, (f) a hoop secured to said basketball backboard, and (g) a swivel pivotally supporting said basketball backboard in a position above said seat back, and (h) means for collapsing said basketball backboard from said position above said seat back to a position behind said seat back.

18. A convertible article according to claim 17 further comprising:

(i) means for recovering a basketball projected from a shooting point into a region surrounding said hoop, and (j) means for returning said basketball to said shooting point.

19. A convertible article according to claim 18 further comprising:

(k) further comprising speed control means for regulating the speed at which said basketball is returned to said shooting point.

20. A convertible article according to claim 19 wherein said speed control means comprises:

(l) an electric motor, (m) a pulley driven by said electric motor, and (n) a curved discharge track positioned for squeezing said basketball against said pulley and thereby control the discharge speed of said basketball.

* * * * *